US011313383B2

(12) United States Patent
Lu

(10) Patent No.: US 11,313,383 B2
(45) Date of Patent: Apr. 26, 2022

(54) FAN MODULE FRAME

(71) Applicants: INVENTEC (PUDONG) TECHNOLOGY CORPORATION, Shanghai (CN); INVENTEC CORPORATION, Taipei (TW)

(72) Inventor: Xiaogang Lu, Shanghai (CN)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 50 days.

(21) Appl. No.: 16/796,781

(22) Filed: Feb. 20, 2020

(65) Prior Publication Data

US 2021/0207616 A1 Jul. 8, 2021

(30) Foreign Application Priority Data

Jan. 3, 2020 (CN) ..... 202010006923.3

(51) Int. Cl.
*F04D 29/40* (2006.01)

(52) U.S. Cl.
CPC ..... *F04D 29/403* (2013.01)

(58) Field of Classification Search
CPC .... F04D 29/403; F04D 25/166; F04D 29/646; F04D 29/601; H05K 7/20172
USPC ..... 415/213.1; 361/695; 29/601
See application file for complete search history.

(56) References Cited

U.S. PATENT DOCUMENTS

2006/0268514 A1* 11/2006 Fan ..... H05K 7/20581 361/695
2010/0003126 A1* 1/2010 Wang ..... F04D 25/166 415/146
2011/0211948 A1* 9/2011 Hsu ..... F04D 25/166 415/213.1
2012/0328449 A1* 12/2012 Xia ..... F04D 25/0613 416/244 R
2013/0343871 A1* 12/2013 Sun ..... F04D 25/166 415/68
2015/0282384 A1* 10/2015 Ho ..... H05K 7/20172 361/695
2017/0042060 A1* 2/2017 Chen ..... F04D 29/601
2019/0069442 A1* 2/2019 Pav ..... H05K 7/14
2020/0146185 A1* 5/2020 Wu ..... H05K 7/20172

* cited by examiner

*Primary Examiner* — Devon C Kramer
*Assistant Examiner* — Kelsey L Stanek
(74) *Attorney, Agent, or Firm* — Maschoff Brennan

(57) ABSTRACT

A fan module frame is configured to fix a fan module in a chassis. The fan module frame includes a first frame component, a second frame component and two latches. The first frame component connects a server fan unit to the second frame component by an elastic fastener. The second frame component has a plurality of chambers, and each of the chambers is configured for the server fan unit to be placed therein. The latches are disposed on two opposite sides of the second frame component and connected to the second frame component. The second frame component fixes the fan module in the chassis through the latches. As such, the fan module is detachably fixed in the chassis and can be removed from the chassis without additional tools, and the fan module frame is compatible with various servers and models, thereby saving design costs and saving space.

6 Claims, 7 Drawing Sheets

FAN MODULE FRAME

CROSS-REFERENCE TO RELATED APPLICATIONS

This non-provisional application claims priority under 35 U.S.C. § 119(a) on Patent Application No(s). 202010006923.3 filed in China on Jan. 3, 2020, the entire contents of which are hereby incorporated by reference.

BACKGROUND

Technical Field

This disclosure relates to the field of server equipment, more particularly to a fan module frame.

Related Art

With the rapid development of the internet technology, big data has become one of the hottest topics in the information technology field. One of the characteristics of big data is that it includes huge amounts of data, and this makes a bigger challenge for data storage and data management. The demand for servers is increasing in all walks of life, especially the demand for 2U and 4U servers. Furthermore, the quality and performance requirements of the servers are also increasing in all walks of life, and the manufacturers need to customize servers for various applications according to each client's requirements, which results in frequent revision of the servers. Moreover, the heat dissipation requirements of the servers are different for different applications, and the heat dissipation efficiency mainly depends on the rotational speed of the fans and the structure of the chassis.

SUMMARY

In order to solve the abovementioned technical problems, the present disclosure provides a fan module frame, which includes a first frame component, a second frame component and two latches. The first frame component connects a server fan unit to the second frame component by an elastic fastener. The second frame component has a plurality of chambers, and each of the chambers is configured for the server fan unit to be placed therein. The two latches are disposed on two opposite sides of the second frame component, and the two latches are connected to the second frame component. In addition, the second frame component fixes the fan module in the chassis through the two latches.

Optionally, the first frame component is in an L shape and covers two adjacent surfaces of the server fan unit, and neither of the two adjacent surfaces of the server fan unit has an air outlet.

Moreover, the plurality of chambers are arranged in a straight line, in an L shape, in two parallel straight lines, in three parallel straight lines or along four sides of a rectangle.

Further, when the quantity of the plurality of chambers is two, the two chambers are arranged in contact with each other or arranged to be spaced apart from each other; when the quantity of the plurality of chambers is three or more, the three or more chambers are arranged in contact with adjacent one or more of the chambers, the three or more chambers are arranged to be spaced apart from one another, or some of the three or more chambers are arranged in contact with adjacent one or more of the chambers and the others are arranged to be spaced apart from one another.

Furthermore, the second frame component has a positioning hole, and the positioning hole restricts a movement of the second frame component in a horizontal direction.

Still further, each of the two latches includes a switch and a mounting component, the switch is connected to the second frame component by a screw, and the mounting component is fixed to the chassis.

Still further, the switch includes a handle and a lock mechanism, the lock mechanism is connected to the second frame component by a screw, and the lock mechanism can be driven to pivot clockwise or counterclockwise about the screw by the handle. Moreover, the mounting components of the two latches are disposed on opposite sides of the chassis, and the second frame component is disposed between the mounting components of the two latches.

Still further, the lock mechanism has a guiding groove, and the guiding groove is in an arc shape. The mounting component has a guiding pin. The guiding groove and the guiding pin cooperate with each other, such that the mounting component can move in an arc path along the guiding groove.

Still further, the fan module frame further includes an anti-backflow structure, and the anti-backflow structure is disposed in one of the chambers or disposed on one side of the second frame component located away from openings of the chambers.

DETAILED DESCRIPTION

Figure 1:
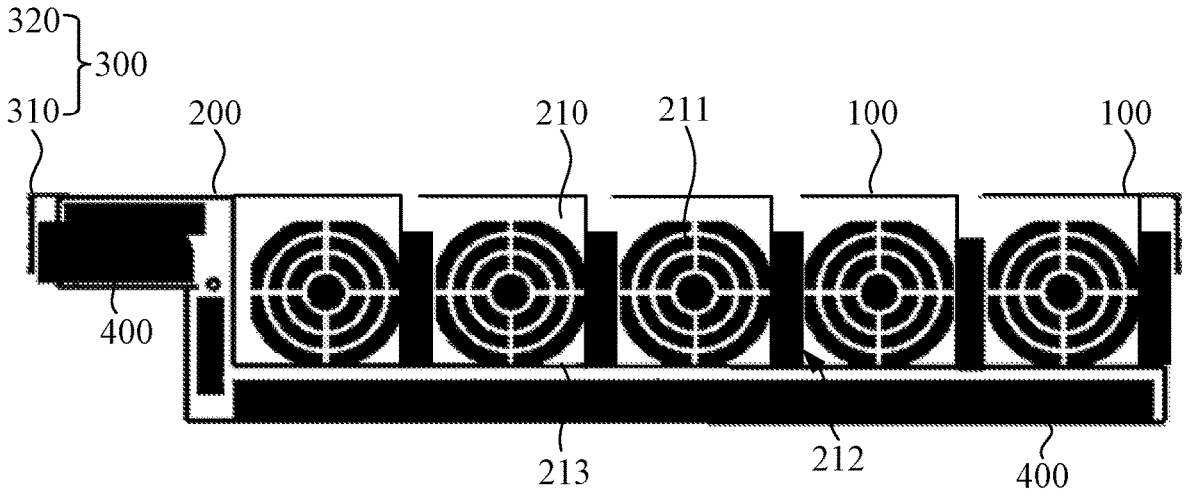
FIG. 1 is a schematic view of a fan module frame in accordance with one embodiment of the disclosure.

The main idea of the present disclosure is to provide a fan module frame, which includes a first frame component, a second frame component and two latches. The first frame component connects a server fan unit to the second frame component by an elastic fastener. The second frame component has a plurality of chambers, and each of the chambers is configured for the server fan unit to be placed therein. The two latches are disposed on two opposite sides of the second frame component, and the two latches are connected to the second frame component. In addition, the second frame component fixes the fan module in a chassis through the two latches. According to the present disclosure, the second frame component fixes the fan module in the chassis by the latches, such that the fan module is detachably fixed in the server chassis and can be detached without additional tools, and the fan module frame is compatible with various servers and models, thereby saving design costs and saving space.

A detailed description of a fan module frame according to the present disclosure is given below. The present disclosure will become more fully understood from the detailed description given hereinbelow with the accompanying drawings, and preferred embodiments were chosen and described. It is understood that person skilled in the art may modify the present disclosure described herein to achieve advantageous effects of the disclosure. Therefore, the following description should be understood as general knowledge to those skilled in the art, and the present disclosure is not limited thereto.

For the purpose of clarity and conciseness, not every detail of the actual embodiments is described hereinbelow. In the following description, general functions and structures are not described because the present disclosure may be obscured due to unnecessary details. It should be understood that in the development of any actual embodiment, a great amount of implementation details has to be made so as to achieve a specific goal of the developers. For example, modifications from one embodiment to another embodiment should refer to relevant system or business restrictions. Moreover, it should be understood that such development work may be complex and time-consuming, but may be merely normal routine work to person skilled in the art.

In order to provide a thorough understanding of the purposes and features of the present disclosure, the detailed description of the embodiments of the present disclosure is given hereinbelow with the accompanying drawings. It should be noted that the drawings are in a very simplified form and all use non-precise proportions that are merely used for conveniently and clearly describing objectives of the embodiments according to the present disclosure.

According to another aspect of this embodiment, a fan module frame is provided, and the fan module frame is configured to detachably fix a fan module in a chassis of a server (e.g., a 2U server). The fan module consists of one or more server fan units. For example, the fan module may consist of one, two, three, four or five server fan units.

Figure 2:
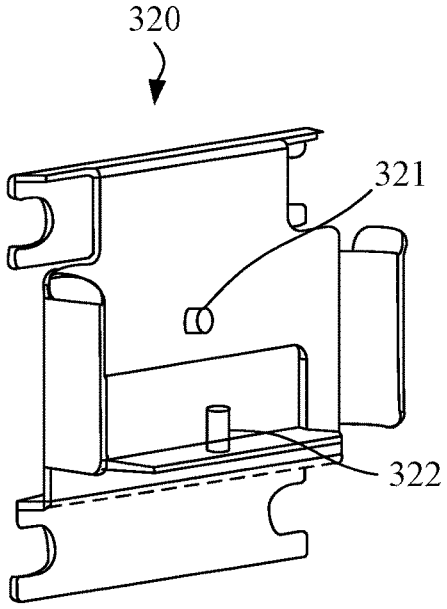
FIG. 2 is a schematic view of a mounting component in accordance with one embodiment of the disclosure.
Figure 3:
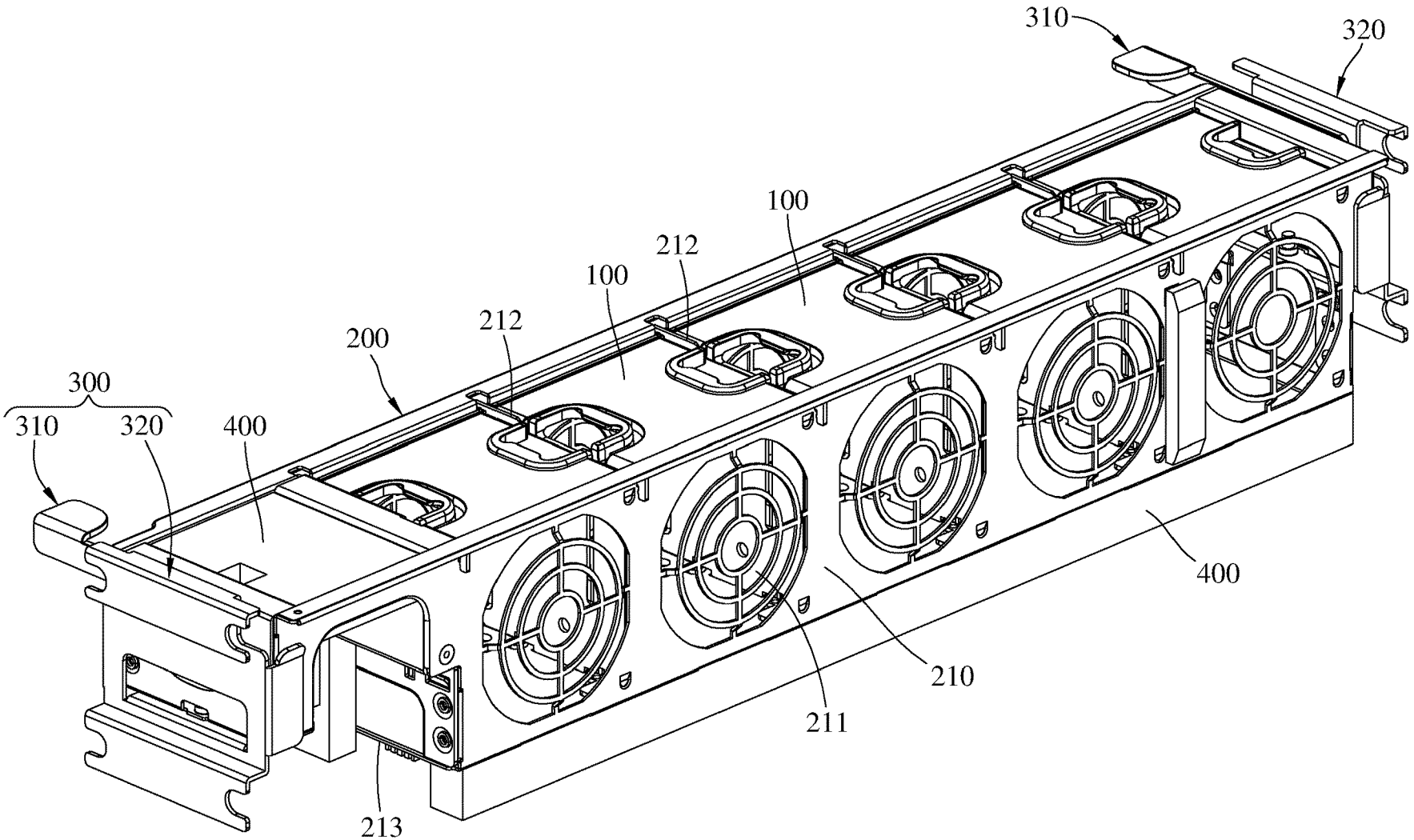
FIG. 3 is a perspective view of the fan module frame in FIG. 1.
Figure 4:
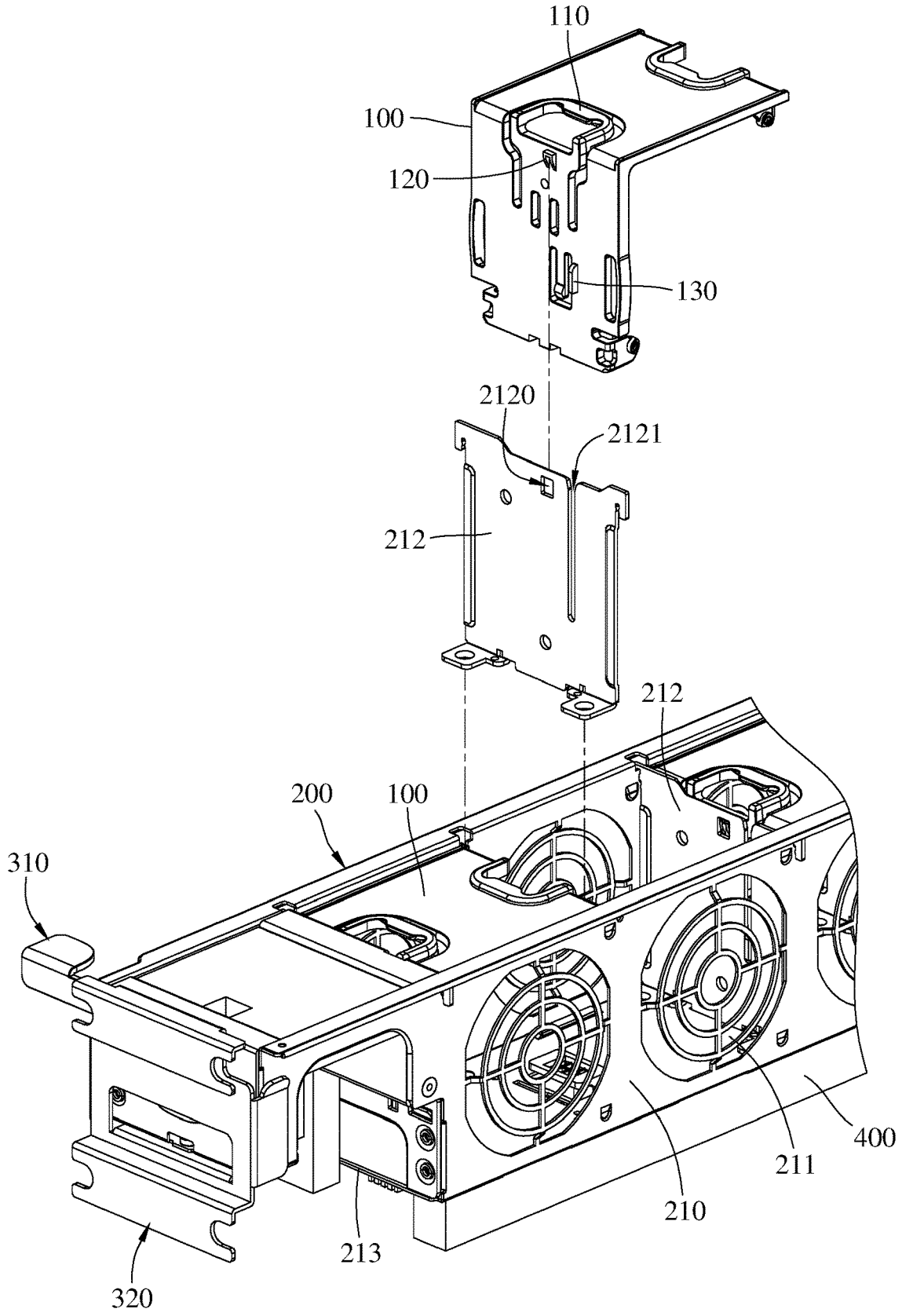
FIG. 4 is a partial exploded view of the fan module frame in FIG. 1.
Figure 5:
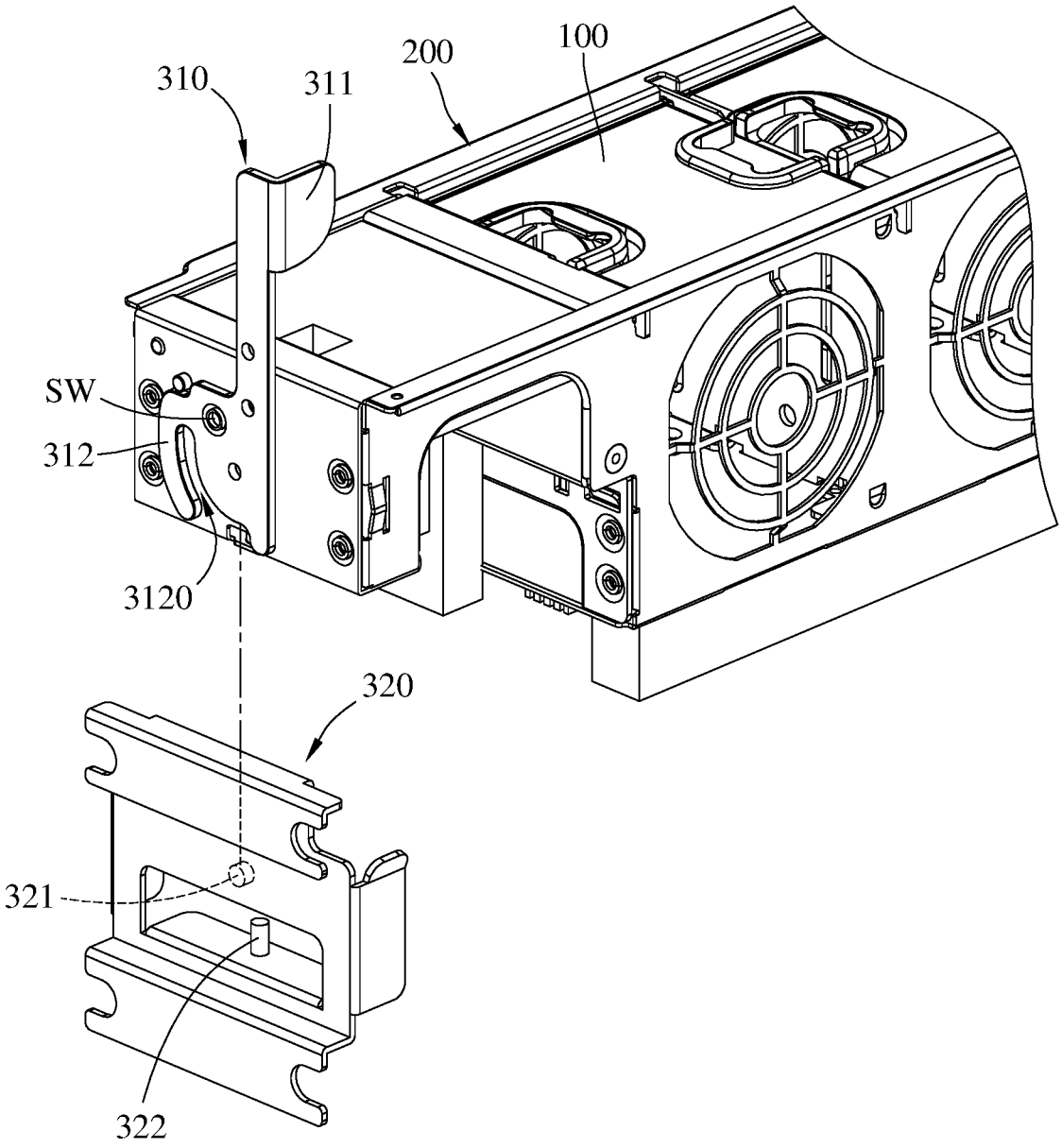
FIG. 5 is another partial exploded view of the fan module frame in FIG. 1.
Figure 6:
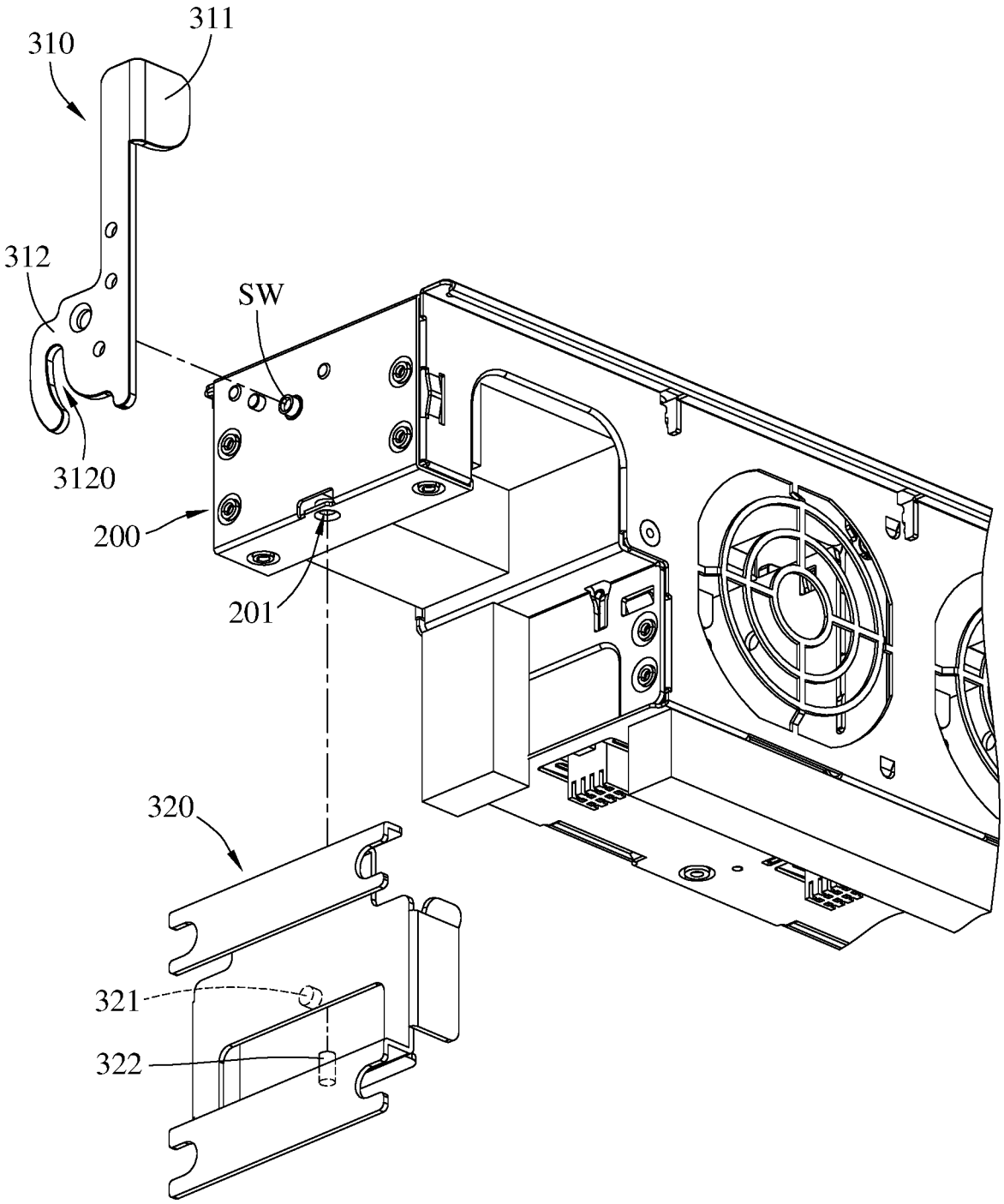
FIG. 6 is another partial exploded view of the fan module frame in FIG. 1.

Referring to FIG. 1 to FIG. 6, FIG. 1 is a schematic view of a fan module frame in accordance with one embodiment of the disclosure, FIG. 2 is a schematic view of a mounting component in accordance with one embodiment of the disclosure, FIG. 3 is a perspective view of the fan module frame in FIG. 1, FIG. 4 is a partial exploded view of the fan module frame in FIG. 1, FIG. 5 is another partial exploded view of the fan module frame in FIG. 1, and FIG. 6 is another partial exploded view of the fan module frame in FIG. 1. As shown in FIG. 1 and FIG. 3, the fan module frame includes a plurality of first frame components 100, a second frame component 200 and two latches 300. The two latches 300 are disposed on two opposite sides of the second frame component 200, and the two latches 300 are connected to the second frame component 200. The second frame component fixes the fan module in the chassis through the latches, such that the fan module is detachably fixed in the chassis of the server (e.g., a 2U server) and can be removed without additional tools, and the fan module frame is compatible with various servers and models, thereby saving design costs and saving space.

The first frame components 100 are configured to fix the server fan units in the second frame component. Each first frame component 100 corresponds to one server fan unit, such that each of the first frame components 100 fixes one of the server fan units. Each of the server fan units is, for example, in a cuboid shape (e.g., in a cubic shape in specific), and two of the six surfaces of the server fan unit that are located on opposite sides of the server fan unit are air outlets. FIG. 1 shows a schematic view of one configuration of the first frame components of the fan module frame in accordance with one embodiment of the disclosure. As shown in FIG. 1, each of the first frame components 100 is, for example, in an L shape covering two adjacent surfaces of one server fan unit, and neither of the two adjacent surfaces has an air outlet. The first frame components 100 connects the server fan units to the second frame component 200 by an elastic fastener 110. Preferably, each of the first frame components 100 has an engaging lock 120, and the engaging lock 120 is configured for the first frame component 100 to be engaged with the second frame component 200. Moreover, each of the first frame components 100 further has a guiding component 130, and the guiding component 130 is configured for the first frame component 100 to be restricted in movement on the second frame component 200.

The second frame component 200 is, for example, made of metal material such as iron in specific. The second frame component 200 has a plurality of chambers 210, and the chambers 210 may be sequentially arranged in a straight line, or the chambers 210 may be arranged in an L shape, in two parallel straight lines, in three parallel straight lines or along four sides of a rectangle, and the arrangement thereof can be changed in accordance with the shape of the accommodating space of the server chassis or in accordance with actual requirements. When the quantity of the chambers 210 is two, the two chambers 210 may be arranged in contact with each other or arranged to be spaced apart from each other. When the quantity of the chambers 210 is three or more, the three or more chambers 210 may be arranged in contact with adjacent one or more of the chambers, the three or more chambers may be arranged to be spaced apart from one another, or some of the three or more chambers may be arranged in contact with adjacent one or more of the chambers and the others may be arranged to be spaced apart from one another. The gap between the chambers is preferable for other component to be disposed therein, and the size of the gap can be designed to be related to the size of the other component therein. In addition, the arrangement of the two or more chambers 210 is adjusted correspondingly to the positions of the first frame components 100. Each chamber 210 is configured for the first frame component 100 of each server fan unit to be placed and fixed therein, and the shape of the chamber 210 is the same as that of the server fan unit placed therein. It can be understood that when there is a small change of the server fan unit (e.g., a size change of the fan), it only needs to adjust the size of the chamber, and thus no need of specialized design. As such, the fan module frame can be compatible with various models of servers, thereby saving design costs and saving the interior space of the chassis. In this embodiment, the second frame component 200 has five chambers 210, and the five chambers 210 are arranged in contact with adjacent ones. The five chambers 210 are sequentially arranged in a straight line. Each chamber 210 is a cuboid with an opening at one end thereof. For example, the chamber 210 is in a cuboid shape being the same as that of the server fan unit. Each of the chambers 210 includes, for example, two ventilation surfaces 211 disposed opposite to each other, two separation surfaces 212 disposed opposite to each other, a support surface 213 and an opening. The support surface 213 and the opening are disposed opposite to each other. The server fan unit is placed into the chamber 210 through the opening, and the support surface 213 is configured to support the server fan unit placed in the chamber 210. The separation surfaces 212 are configured to separate adjacent chambers 210 and to fix the server fan unit in position. Each of the separation surfaces 212 has a recess 2120, and the recess 2120 is configured to hold the engaging lock 120 of the first frame component 100 to be engaged with the chamber 210. Each of the separation surfaces 212 further has a vertical guiding groove 2121, such that the guiding component 130 of the first frame component 100 is able to move downwards along the guiding groove 2121 so as to dispose the first frame component 100 to the chamber 210. The two air outlets of the server fan unit respectively face toward the ventilation surfaces 211, such that air flow from the server fan unit can flow out through the ventilation surfaces 211. The ventilation surfaces 211 have several evenly distributed circular through holes, grid holes or exposed through holes that are formed between concentric rings connected to one another, such that air flow from the air outlet of the server fan unit can flow out through the abovementioned holes so as to cool the chassis. Preferably, a distribution area of ventilation holes on the ventilation surfaces 211 is the same as an outlet area of the air outlet so as to effectively discharge all the air flow from the server fan unit. Preferably, the second frame component 200 further has a positioning hole 201, and the positioning hole 201 is configured to limit the position of the second frame component 200 so as to restrict the movement of the second frame component 200 in a horizontal direction (e.g., on the radial plane of the positioning hole 201).

The fan module frame further includes anti-backflow structures 400, and the anti-backflow structures 400 are made of, but not limited to, light-weighted foam. The anti-backflow structures 400 are disposed in the chambers 210. In specific, the anti-backflow structures 400 are, for example, disposed on the separation surfaces 212 and the support surfaces 213 of the chambers 210. The anti-backflow structures may be disposed on one side of the second frame component 200 located away from the openings of the chambers 210, disposed in the gaps between every two adjacent chambers 210, and disposed on one side of the separation surfaces 212 of the chambers 210 so as to prevent back flow.

Each of the latches 300 includes at least one switch 310 and a mounting component 320. The switch 310 is connected to the second frame component 200 by a screw SW, such that the switch 310 is pivotably fixed to the second frame component 200 by taking the screw SW as a pivoting center. At this moment, the two switches 310 are disposed on two opposite sides of the chambers 210, and specifically, the two switches 310 are, for example, disposed on two opposite sides of the chambers 210 along the arrangement direction of the chambers 210. By counterclockwise pivoting the switches 310 on the second frame component 200 about the screws SW, the fan module frame can be installed on the chassis. By clockwise pivoting the switches 310 on the second frame component 200 about the screws SW, the fan module frame can be removed from the chassis. The installation and removal processes can be easily done without additional tools.

Figure 7:
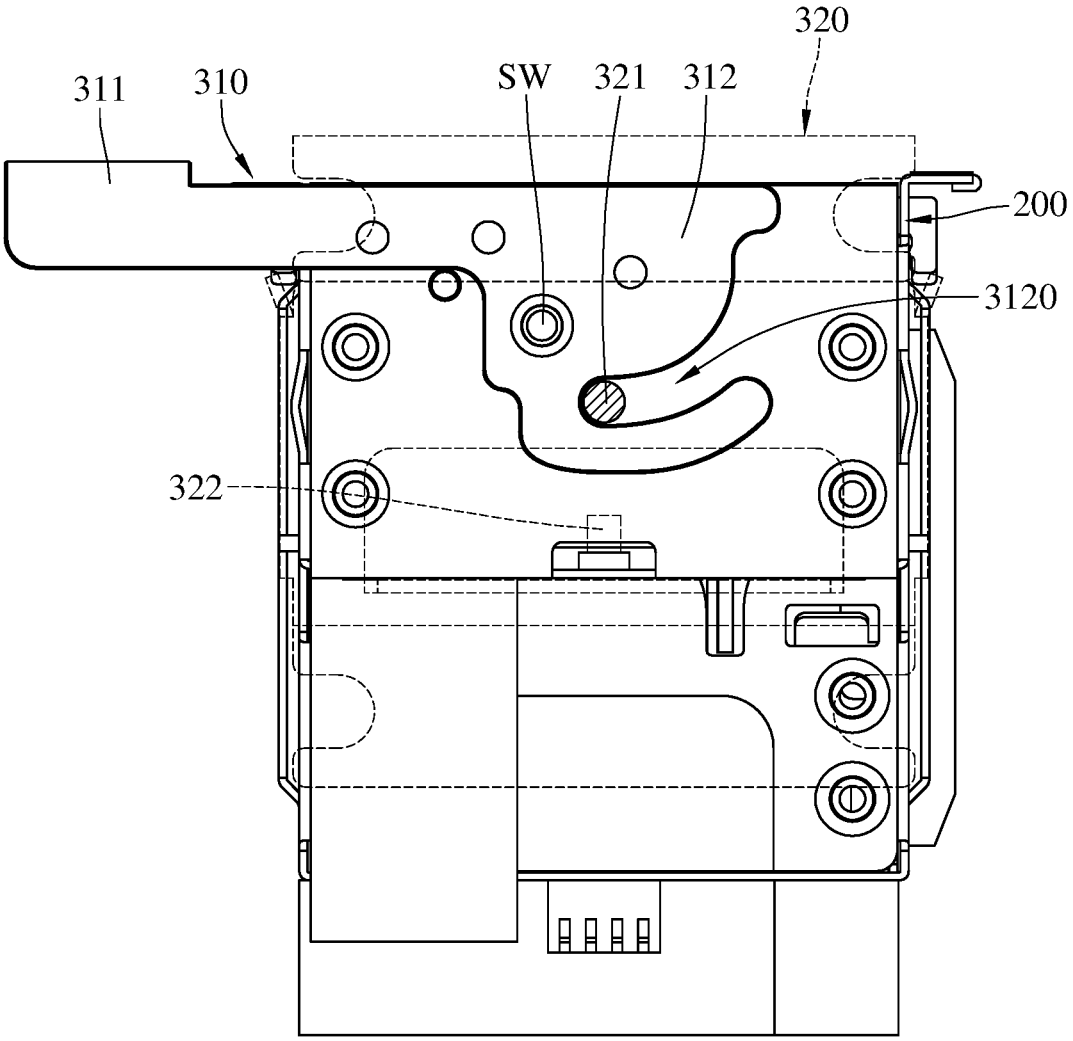
FIG. 7 and FIG. 8 show the operation of the switch of the latch in FIG. 1.
Figure 8:
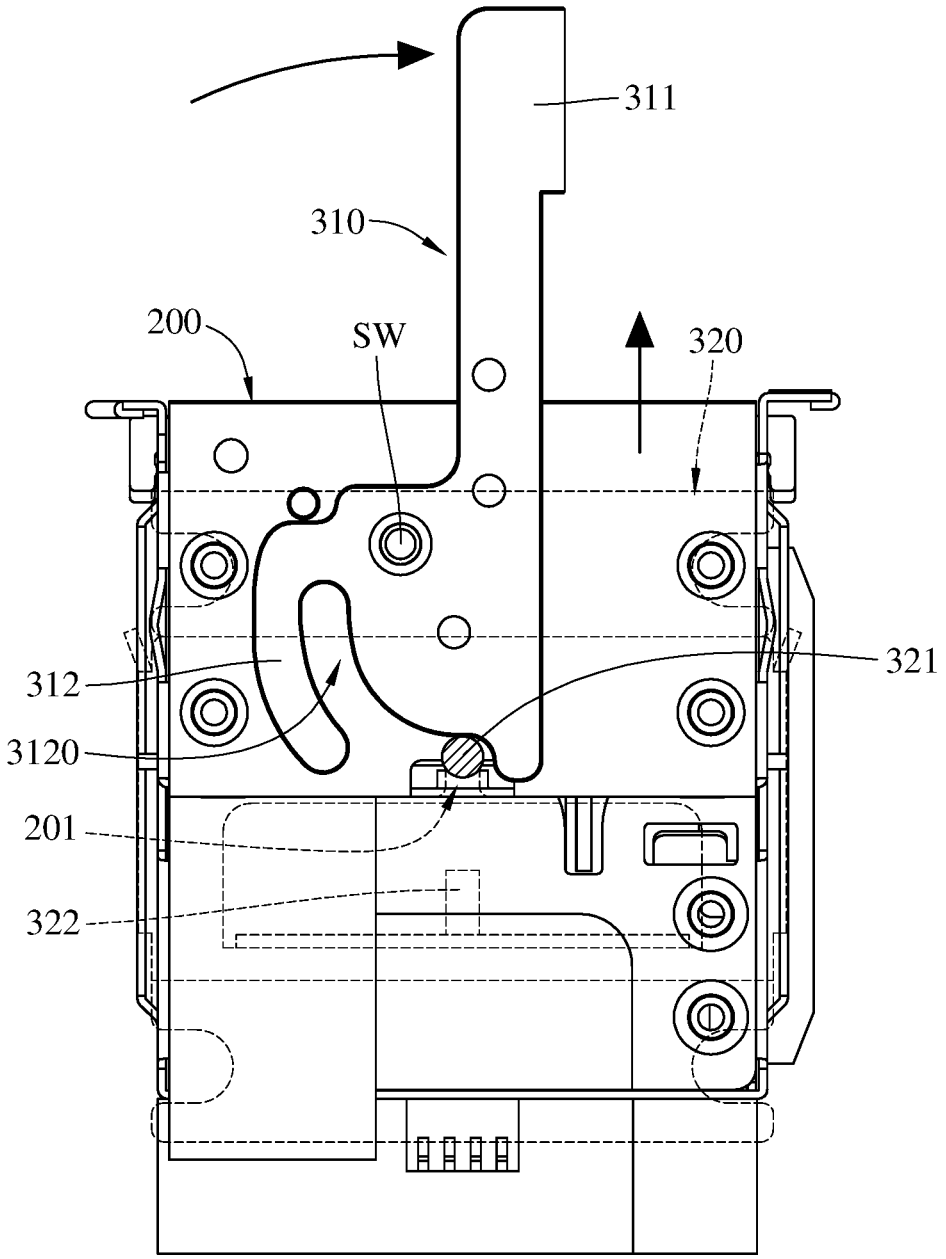

Referring to FIG. 7 and FIG. 8, which show the operation of the switch of the latch. Each of the switches 310 includes a handle 311 and a lock mechanism 312, and the handle 311 and the lock mechanism 312 are, for example, fixedly connected to each other. The lock mechanism 312 and the second frame component 200 are connected to each other by the screw SW, and the lock mechanism 312 can be driven to pivot clockwise or counterclockwise about the screw SW by the handle 311. The lock mechanism 312 has a guiding groove 3120, and the guiding groove 3120 is in an arc shape.

The mounting components 320 are fixed to the chassis. Specifically, the two mounting components 320 of the two latches 300 are disposed on opposite sides of the chassis, and the second frame component 200 is disposed between the two mounting components 320 of the two latches 300. The mounting components 320 are disposed on the chassis (e.g., on the shell of the chassis) and fixedly connected to the chassis by screws. Preferably, a cushion is disposed at a position where the mounting component 320 is connected to the chassis, and the cushion is configured to absorb vibration or impact between the chassis and the fan module frame in any direction (e.g., in a X-direction, Y-direction and Z-direction), thereby effectively reducing the interference from the vibration of the fans to the hard disk drive (HDD) during reading or writing. Specifically, each of the mounting components 320 has a through hole, and the through hole is, for example, in a U-shaped. The second frame component is connected to the chassis by the cooperation between the screws and through holes. The cushions are disposed in the through holes and are sleeved on the screws passing through the through holes, thereby providing a vibration or impact absorbing function.

Each of the mounting components 320 has a positioning pin 322. By placing the positioning pin 322 in the positioning hole 201 of the second frame component 200, the second frame component 200 can be positioned. Each of the mounting components 320 further has a guiding pin 321 corresponding to the guiding groove 3120. The guiding pins 321 are configured to be slidably located in the guiding grooves 3120, respectively. There can be a relative movement between the guiding pins 321 and the guiding grooves 3120 in an arc path along the guiding groove guiding grooves 3120, so the lock mechanisms 312 are detachable from the mounting components 320, and thereby the second frame component 200 is movable upward or downward vertically so as to be placed into or removed from the chassis. The abovementioned processes can be easily done without additional tools.

According to the fan module frame as described above, the fan module frame includes the first frame components, the second frame component and the two latches. The first frame components connect the server fan units to the second frame component by the elastic fasteners. The second frame component has the plurality of chambers, and each of the chambers is configured for one server fan unit to be placed therein. The two latches are disposed on two opposite sides of the second frame component and connected to the second frame component. In addition, the second frame component fixes the fan module in the chassis through the latches. According to the present disclosure, the second frame component fixes the fan module in the chassis by the latches, such that the fan module is detachably fixed in the server chassis and can be removed without additional tools, and the fan module frame is compatible with various servers and models, thereby saving design costs and saving space.

Additionally, it is noted that unless otherwise stated or indicated, the terms "first", "second", etc. are only used herein to distinguish one component, element or process from another, without necessarily requiring or involving any logical relationship or sequence between such components, elements, or processes.

It can be understood that the preferred embodiments were chosen and described above, but the present disclosure is note limited thereto. For those skilled in the art, without departing from the scope of the technical solution of the present disclosure, many possible changes and modifications can be made to the technical solution of the present disclosure or equivalent embodiments with equivalent changes can be obtained by modifying the technical solution of the present disclosure in accordance with the technical content disclosed above. Accordingly, any simple modifications, equivalent changes and modifications made to the above embodiments according to the technical essence of the present disclosure without departing from the content of the technical solution of the present disclosure still fall within the scope of the technical solution of the present disclosure.

What is claimed is:

1. A fan module frame, configured to fix a fan module in a chassis, the fan module frame comprising a first frame component, a second frame component and two latches, the first frame component connecting a server fan unit to the second frame component by an elastic fastener, the second frame component having a plurality of chambers, each of the plurality of chambers being configured for the server fan unit to be placed therein, the two latches being disposed on two opposite sides of the second frame component, and the two latches being connected to the second frame component;

wherein the second frame component fixes the fan module in the chassis through the two latches;

wherein each of the two latches comprises a switch and a mounting component, each of the switch comprises a handle and a lock mechanism connected to each other, the lock mechanisms are pivotably connected to the second frame component by screws, the lock mechanisms can be driven to pivot clockwise or counterclockwise about the screws by the handles, the mounting components are fixed to and disposed on opposite sides of the chassis, and the second frame component is disposed between the mounting components;

wherein each of the lock mechanisms has a guiding groove, each of the guiding grooves is in an arc shape, each of the mounting components has a guiding pin, and the guiding pins are configured to be slidably located in the guiding grooves, respectively; when the lock mechanisms are driven to pivot clockwise or counterclockwise about the screws by the handles, there can be a relative movement between the guiding grooves and the guiding pins in an arc path along the guiding grooves, allowing the lock mechanisms to be disengaged from or engaged with the mounting components.

2. The fan module frame according to claim 1, wherein the first frame component is in an L shape, the first frame component covers two adjacent surfaces of the server fan unit, and neither of the two adjacent surfaces of the server fan unit has an air outlet.

3. The fan module frame according to claim 2, wherein the plurality of chambers are arranged in a straight line, in an L shape, in two parallel straight lines, in three parallel straight lines or along four sides of a rectangle.

4. The fan module frame according to claim 3, wherein when a quantity of the plurality of chambers is two, the two chambers are arranged in contact with each other or arranged to be spaced apart from each other; when a quantity of the plurality of chambers is three or more, the three or more chambers are arranged in contact with adjacent one or more of the chambers, the three or more chambers are arranged to be spaced apart from one another, or some of the three or more chambers are arranged in contact with adjacent one or more of the chambers and others are arranged to be spaced apart from one another.

5. The fan module frame according to claim 1, wherein the second frame component has a positioning hole, and the positioning hole restricts a movement of the second frame component in a horizontal direction.

6. The fan module frame according to claim 1, further comprising at least one anti-backflow structure, wherein the at least one anti-backflow structure is made of foam and disposed in one of the plurality of chambers or disposed on one side of the second frame component located away from openings of the plurality of chambers.

* * * * *